United States Patent [19]

Imura et al.

[11] Patent Number: 4,875,518

[45] Date of Patent: Oct. 24, 1989

[54] METHOD OF AND APPARATUS FOR LOW-PRESSURE CASTING OF LIGHT METAL ALLOY

[75] Inventors: Takeshi Imura; Katsuhiko Ando; Shigemitsu Nakabayashi; Maki Hirose, all of Sayama, Japan

[73] Assignee: Honda Giken Kogyo Kabushiki Kaisha, Tokyo, Japan

[21] Appl. No.: 233,144

[22] Filed: Aug. 17, 1988

[30] Foreign Application Priority Data

Aug. 21, 1987 [JP] Japan ..... 62-207777
Aug. 21, 1987 [JP] Japan ..... 62-207779

[51] Int. Cl.[4] ..... B22D 18/04

[52] U.S. Cl. ..... 164/119; 164/122.1; 164/138; 164/306

[58] Field of Search ..... 164/113, 119, 122, 122.1, 164/137, 138, 306, 307, 308, 309, 310, 311, 312, 342, 343, 348

[56] References Cited

U.S. PATENT DOCUMENTS 3,874,440 4/1975 Voisin ..... 164/306

FOREIGN PATENT DOCUMENTS 620334 8/1978 U.S.S.R. ..... 164/122
628997 10/1978 U.S.S.R. ..... 164/122
916080 4/1982 U.S.S.R. ..... 164/122.1
493013 9/1938 United Kingdom .
1133029 11/1968 United Kingdom .
1161769 8/1969 United Kingdom .
1410770 10/1976 United Kingdom .
2067441 7/1981 United Kingdom .
2196281 4/1988 United Kingdom .

*Primary Examiner*—Richard K. Seidel
*Attorney, Agent, or Firm*—Birch, Stewart, Kolasch & Birch

[57] ABSTRACT

A light metal alloy such as an aluminum alloy is cast into a casting such as an automobile engine cylinder head under low pressure. A fluid pressure is applied to the surface of a light metal alloy stored in a closed container to introduce the light metal alloy from the closed container through a transfer tube and a sprue into a mold cavity defined in a mold assembly. The introduced molten metal alloy is brought into contact with molds of the mold assembly which have different thermal conductivities, respectively. The time in which the molten metal alloy is solidified is controlled by the molds of different thermal conductivities. The molds may forcibly be cooled by a cooling medium passing therethrough or cooling blocks mounted thereon.

20 Claims, 4 Drawing Sheets

METHOD OF AND APPARATUS FOR LOW-PRESSURE CASTING OF LIGHT METAL ALLOY

BACKGROUND OF THE INVENTION

The present invention relates to a method of and an apparatus for low-pressure casting of a light metal alloy, and more particularly to a method of and an apparatus for low-pressure casting of a light metal alloy to produce a high-quality casting free of casting defects by introducing a molten metal alloy into a mold assembly constructed of materials of different thermal conductivities and causing the molten metal alloy filled in a mold cavity defined in the mold assembly to be progressively solidified in a certain direction due to the different thermal conductivities of the mold assembly materials, the method and the apparatus being capable of increasing the production efficiency by shortening the cycle time of the casting process.

Generally, the low-pressure casting process is widely employed in the mass-production of automotive parts or the like, for example. The low-pressure casting process produces a casting by pouring a molten metal alloy such as an aluminum alloy into a closed container, and exerting a low pressure to the surface of the molten metal alloy with a gas introduced under a relatively low pressure, typically compressed air, to force the molten metal alloy through a tube into a mold cavity defined in a mold assembly complementarily in shape to the casting to be produced.

One low-pressure casting apparatus generally used in the low-pressure casting process is schematically illustrated in FIG. 1 of the accompanying drawings by way of example.

The low-pressure casting apparatus, generally denoted at 2, basically comprises a mold assembly 3 and a molten metal feeder 4. The mold assembly 3 comprises an upper mold 5, a lower mold 6, and a pair of lateral molds *7a*, *7b* fitted in the upper and lower molds 5, 6, thus defining therebetween a mold cavity 8 complemetary in shape to a casting to be produced. The lower mold 6 is mounted on a fixed mold base 9, the lower mold 6 having a sprue 10. The upper mold 5 is mounted on a movable mold base 12 which is vertically displaceable by a pressure cylinder 11. The lateral molds *7a*, *7b* are coupled respectively to cylinders *13a*, *13b*, the lateral molds *7a*, *7b* being horizgntally movable for opening the mold assembly 3 by the cylinders *13a*, *13b*.

The molten metal feeder 4 includes a heating furnace 14 housing therein a pot 15 for storing a molten metal, with a heater 16 disposed around the pot 15. A transfer tube 17 is partly placed in the pot 15 and has an upper end connected to the sprue 10. A tube 18 for supplying and discharging compressed air is connected to the heating furnace 14.

When compressed air under a prescribed pressure is supplied through the tube 18 into the heating furnace 14, the molten metal stored in the pot 15 is forced under the pressure applied to its upper surface through the transfer tube 17 and the sprue 10 into the mold cavity 8 in the mold assembly 3. After the molten metal has been filled in the mold cavity 8 and held therein under a prescribed pressure, the compressed air is discharged from within the heating furnace 14 via the tube 18, and the molten metal filled in the mold cavity 8 is cooled and solidified for a give period of time. A casting having a shape complementary to the mold cavity 8 is thus produced in one cycle (see FIG. 2) of such a casting process.

For producing a high-quality casting having a good structure free of casting defects in such low-pressure casting process, it is necessary to effect so-called directional solidification for allowing the molten metal in the mold cavity to be solidified quickly and progressively from an end of the mold cavity toward the sprue. The directional solidification is effective to remove casting defects such as shrinkage cavities which would otherwise be present in the casting.

Various methods have heretofore been proposed to control the temperature of the mold assembly used in the low-pressure casting process for directional solidification of molten metal filled in the mold cavity. The temperature of the mold assembly periodically varies in one cycle of the casting process as shown in FIG. 2. Since the mold assembly is generally made of steel or the like which has a low thermal conductivity, it is poor in its response to temperature regulation. Therefore, it is highly difficult to perform temperature control for directional solidification, and no substantially effective temperature control has been possible so far.

One conventional practice has been to adjust the casting cycle to increase the time in which to pressurize molten metal to be supplied to the mold cavity in order to keep the mold assembly temperature within a predetermined temperature range, and then to allow the molten metal to be solidified of its own accord over a relatively long period of time for thereby preventing casting defects from occurring. Actually, however, casting defects such as shrinkage cavities or the like tend to be developed in relatively thick portions of a casting. Another problem is that the casting efficiency is not increased since the cycle time is increased.

SUMMARY OF THE INVENTION

It is a general object of the present invention to provide a method of and an apparatus for low-pressure casting of a light metal alloy to produce a high-quality casting having a good structure free of casting defects such as shrinkage cavities or the like by introducing a molten metal alloy into a mold cavity defined in a mold assembly constructed of molds of different thermal conductivities and thereafter causing the molten metal alloy filled in the mold cavity to be progressively solidified in a certain direction by directional solidification due to the different thermal conductivities of the molds and/or the control of a cooling medium supplied to the molds, the method and the apparatus being capable of increasing the production efficiency by shortening the cycle time of the casting process.

Another object of the present invention is to provide a method of low-pressure casting of a light metal alloy, comprising the steps of: applying a fluid pressure on the surface of a light metal alloy stored in a closed container to introduce the light metal alloy from the closed container through a transfer tube and a sprue into a mold cavity defined in a mold assembly; bringing the introduced molten metal alloy into contact with molds of the mold assembly which have different thermal conductivities, respectively; and controlling a time in which the molten metal alloy is solidified with the molds to produce a casting.

Still another object of the present invention is to provide a method of low-pressure casting of a light metal alloy, wherein the molten metal alloy is brought into contact with at least two molds of the mold assembly which have respective different thermal conductivities, the mold of a higher thermal conductivity being disposed in a region where the molten metal alloy is to be solidified earlier and the mold of a lower thermal conductivity being disposed in a region where the molten metal alloy is to be solidified later, for thereby controlling the time in which the molten metal alloy is solidified.

Yet another object of the present invention is to provide a method of low-pressure casting of a light metal alloy, wherein the molten metal alloy is progressively solidified downwardly toward the mold which has the sprue.

Still another object of the present invention is to provide a method of low-pressure casting of a light metal alloy, wherein the mold of a higher thermal conductivity is made of a copper alloy and the mold of a lower thermal conductivity is made of carbon tool steel.

Yet still another object of the present invention is to provide a method of low-pressure casting of a light metal alloy, wherein the molds are supplied with a cooling medium under cooling conditions including the type of the cooling medium, a cooling starting time, and a flow rate, for forcibly cooling the molten metal alloy.

Another object of the present invention is to provide a method of low-pressure casting of a light metal alloy, where the cooling medium is air and/or water.

A further object of the present invention is to provide an apparatus for low-pressure casting of a light metal alloy, comprising: a mold assembly defining a mold cavity for receiving a light metal alloy therein, the mold assembly being composed of an upper mold, a lower mold having a sprue, and slidable molds separably fitted in the upper and lower molds, the upper, lower, and slidable molds being made of metallic materials having different thermal conductivities which are progressively lower in a direction from the upper mold toward the lower mold.

A still further object of the present invention is to provide an apparatus for low-pressure casting of a light metal alloy, wherein at least the upper and slidable molds are made of a copper alloy having a higher thermal conductivity, and the lower mold is made of carbon tool steel having a lower thermal conductivity.

A yet further object of the present invention is to provide an apparatus for low-pressure casting of a light metal alloy, further comprising cooling blocks disposed in intimate contact with substantially entire rear surfaces of at least the upper and slidable molds remote from the mold cavity, the cooling blocks being made of a copper alloy of a higher thermal conductivity and having passages defined therein for passage of a cooling medium supplied and discharged by a cooling medium supply/discharge system.

A still further object of the present invention is to provide an apparatus for low-pressure casting of a light metal alloy, wherein the upper, lower, and slidable molds are supplied with a cooling medium.

Another object of the present invention is to provide an apparatus for low-pressure casting of a light metal alloy, wherein the cooling medium supplied to the upper and slidable molds is water, and the cooling medium supplied to the lower mold is air or water.

Still another object of the present invention is to provide an apparatus for low-pressure casting of a light metal alloy, further comprising cooling blocks mounted on at least the upper and slidable molds and having holes defined therein for passage of a cooling medium which is controllably supplied.

Yet another object of the present invention is to provide an apparatus for low-pressure casting of a light metal alloy, further comprising cooling blocks disposed in intimate contact with substantially entire rear surfaces of at least the upper and slidable molds remote from the mold cavity, the cooling blocks being made of a copper alloy of a higher thermal conductivity, the upper, slidable, and lower molds being made of carbon tool steel.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
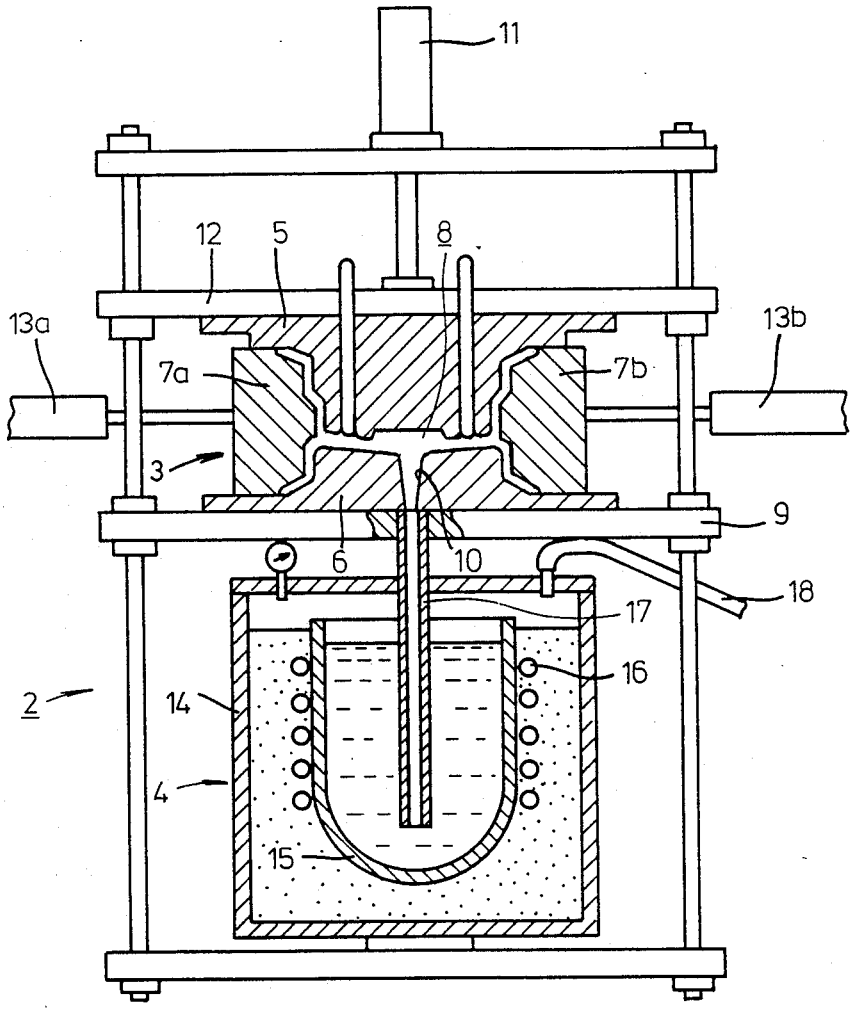
FIG. 1 PRIOR ART
FIG. 1 is a vertical cross-sectional view of a conventional low-pressure casting apparatus.
Figure 2:
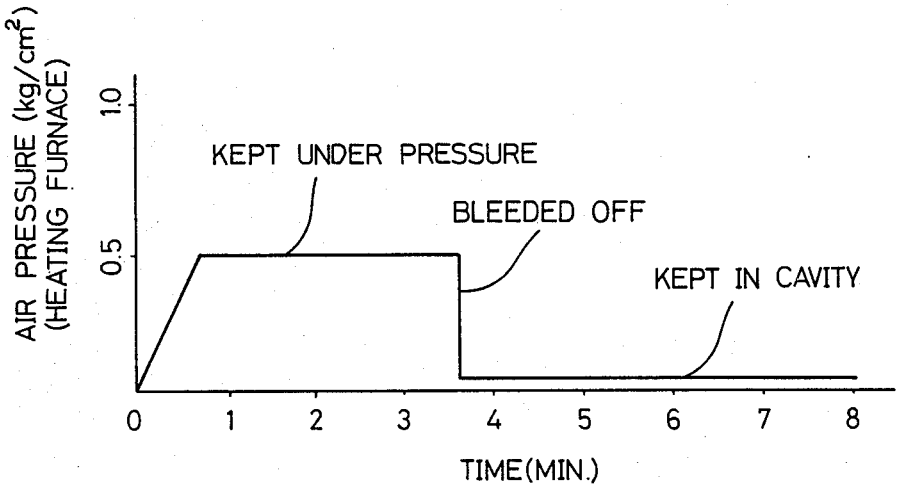
FIG. 2 PRIOR ART
FIG. 2 is a graph showing a conventional casting cycle.
Figure 3:
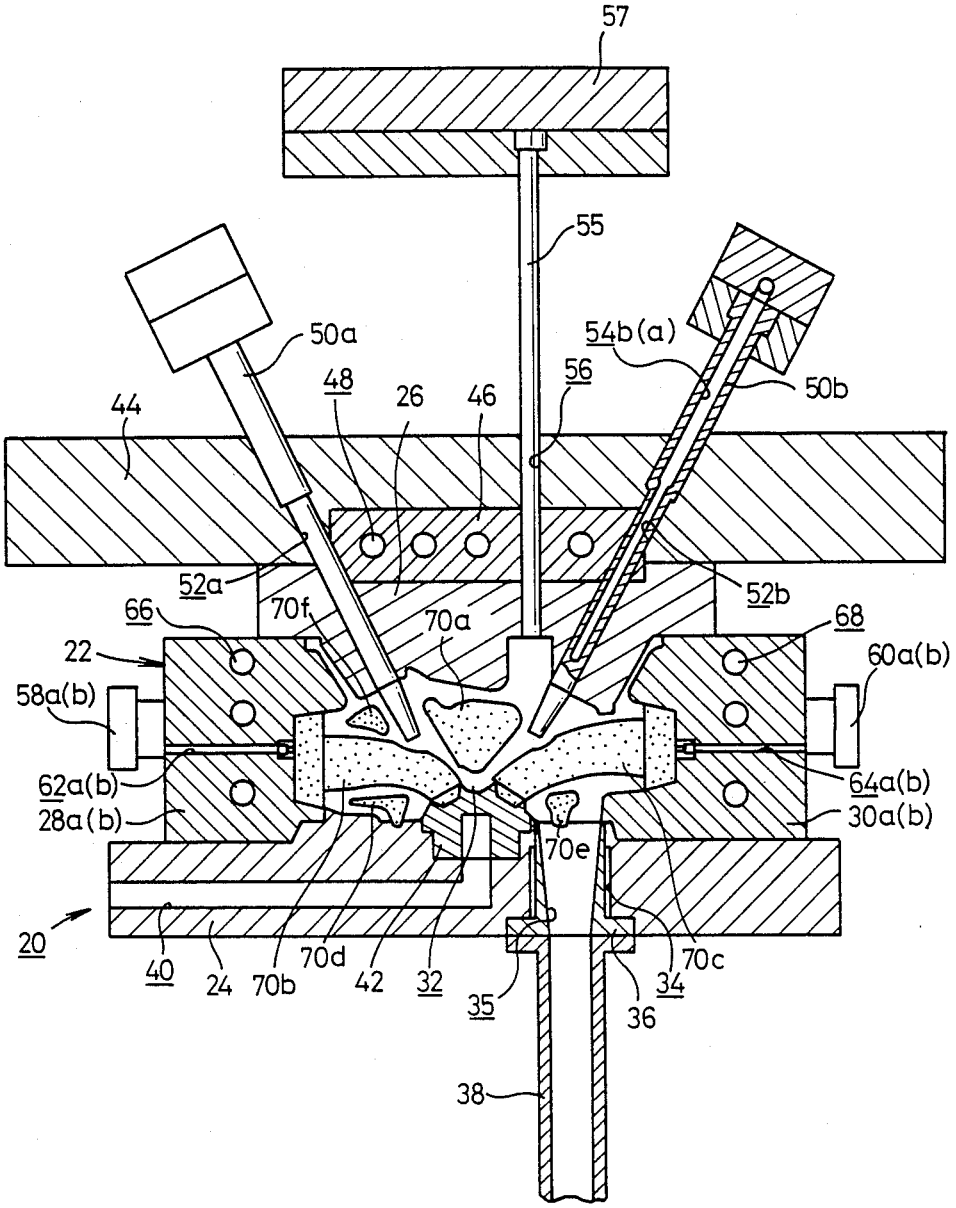
FIG. 3 is a vertical cross-sectional view of a low-pressure casting apparatus employed for carrying out a method of low-pressure casting of a light metal alloy according to an embodiment of the present invention.

FIG. 3 shows a casting apparatus 20 for carrying out a low-pressure casting method according to an embodiment of the present invention. The casting apparatus 20 includes a casting mold assembly 22 comprising a lower mold 24, an upper mold 26 disposed above the lower mold 24, and two pairs of slidable molds **28*a*, 28*b* and 30*a*, 30*b* which are slidably fitted in the lower and upper molds 24, 26. The upper mold 26, the lower mold 24, and the slidable molds 28*a*, 28*b*, 30*a*, 30*b* define a mold cavity 32 therebetween. In the illustrated embodiment, the mold cavity 32 is of a shape for casting a cylinder head for an internal combustion engine for an automobile or the like. As described later on, the lower mold 24, the upper mold 26, and the slidable molds 28*a*, 28*b*, 30*a*, 30*b*** are made of metallic materials which have different thermal conductivities.

The lower mold 24 has a stepped hole 34 defined therein, and a nozzle 36 having a sprue 35 communicating with the mold cavity 32 is fitted in the stepped hole 34. To the nozzle 36, there is coupled a stalk or transfer tube 38 for feeding a molten metal alloy, the stalk 38 having a lower portion disposed in a pot (not shown) positioned below the lower mold 24 for storing the molten metal alloy. The lower mold 24 also has a passage 40 defined therein for introducing a cooling fluid, the passage 40 extending to a core 42 disposed in the lower mold 24.

The upper mold 26 is mounted on a mold base 44 which is coupled to an actuator such as a cylinder (not shown) or the like and vertically displaceable thereby. A cooling block 46 is interposed between the mold base 44 and the upper mold 26 and has a plurality of passages 48 for introducing a cooling medium. Chills 50*a*, 50*b* are inserted respectively through holes 52*a*, 52*b* defined in the mold base 44 and the upper mold 26 for rapidly cooling relatively thick portions of a cylinder head to be cast, which have holes through which valve guides are to be inserted. The chills 50*a*, 50*b* have respective passages 54*a*, 54*b* defined therethrough for being filled with a cooling fluid. An ejector rod 55 is inserted through a hole 56 defined through the mold base 44, the cooling block 46, and the upper mold 26 for ejecting a casting from the mold cavity 32 after the mold assembly 22 is opened. The ejector rod 55 has a proximal end mounted in an attachment member 57 and a distal end disposed in the mold cavity 32.

The slidable molds 28*a*, 28*b* and 30*a*, 30*b* fitted in the lower mold 24 and the upper mold 26 are operatively coupled to actuators such as cylinders or the like through couplings 58*a*, 58*b* and 60*a*, 60*b*, respectively. The slidable molds 28*a*, 28*b* and 30*a*, 30*b* have vents 62*a*, 62*b* and 64*a*, 64*b*, respectively, defined therein and communicating with the mold cavity 32 for the escape of gases, and also have passages 66, 68 for passage therethrough of a cooling medium in a direction perpendicular to the vents 62*a*, 62*b* and 64*a*, 64*b*.

Sand cores 70*a* through 70*f* are disposed in the mold cavity 32. The sand cores 70*b*, 70*c* serve to define intake and discharge passages in the cylinder head, and the sand cores 70*a*, 70*d* through 70*f* serve to define a water jacket in the cylinder head.

The low-pressure casting method of casting a light metal alloy by employing the mold assembly 22 thus constructed will be described below.

The molds of the mold assembly 22 are made of metallic materials shown in the following table 1:

TABLE 1

| | Material | Thermal conductivity cal/cm · s · °C. |
|---|---|---|
| Lower mold 24 | JIS SKD 61 | 0.08 |
| Slidable molds 28a(b), 30a(b) | Be—Cu alloy | 0.45 |
| Upper mold 26 | Cr—Cu alloy | 0.77 |

The sand cores 70*a* through 70*f* are placed in position in the mold cavity 32 defined in the mold assembly 22. The sand cores 70*a* through 70*f* are preferably made of resin-coated sand, for example, which is shaped by corresponding molds. Then, the cylinders (not shown) are actuated to move the upper mold 26, and the slidable molds 28*a*, 28*b* and 30*a*, 30*b* toward the lower mold 24 to complete the mold assembly 22.

A molten aluminum alloy is introduced into the mold cavity 32 from the stalk 38 via the sprue 35 in the nozzle 36. At this time, the molten aluminum alloy of JIS AC 2B is kept at a temperature of 680° C., held in the mold cavity 32 under a pressure of 0.28 kg/cm$^2$, and kept in the mold cavity 32 for a casting cycle of 3 minutes. More specifically, the molten aluminum alloy stored in the non-illustrated pot is maintained at 680° C., and compressed air is applied to the surface of the molten aluminum alloy in the pot to feed the molten aluminum alloy through the stalk 38 and the sprue 35 into the mold cavity 32 where the molten aluminum alloy is held under a pressure of 0.28 kg/cm$^2$.

After the molten aluminum alloy has been kept under the pressure of 0.28 kg/cm$^2$ for the aforesaid cycle time, the compressed air is removed from the pot, and the molten aluminum alloy filled in the mold cavity 32 is solidified by being cooled. As shown in the table 1 above, the lower mold 24, the upper mold 26, and the slidable molds 28*a*, 28*b* and 30*a*, 30*b* are made of materials of different thermal conductivities. The material of the lower mold 24 is of carbon tool steel which is of the lowest thermal conductivity among the mold materials.

Therefore, when the high-temperature molten aluminum alloy is solidified and shrunk in the mold cavity 32, the cooling process is controlled such that the portion of the molten aluminum alloy around the lower mold 24 will finally be solidified so as to allow the molten aluminum alloy additionally to be fed into the mold cavity 32 from the sprue 35. The slidable molds 28*a*, 28*b* and 30*a*, 30*b* are made of beryllium bronze which is of a thermal conductivity higher than that of the material of the lower mold 24, and the upper mold 26 is made of a chromium-copper alloy which has a thermal conductivity higher than that of the material of the slidable molds 28*a*, 28*b* and 30*a*, 30*b*. Therefore, due to the different thermal conductivities of these molds, the heat radiation from the molten aluminum alloy filled in the mold cavity 32 is promoted or delayed so that the molten aluminum alloy is progressively solidified in a direction from the upper mold 26 through the slidable dies 28*a*, 28*b* and 30*a*, 30*b* toward the lower mold 24 for directional solidification. Consequently, casting defects such as shrinkage cavities and the like are prevented from being developed in a casting being formed, which is therefore of a good structure and high quality.

The passages 48, 66, 68, 40 in the cooling block 46, the slidable molds 28*a*, 28*b*, 30*a*, 30*b*, and the lower mold 24 are supplied with a cooling medium such as cooling water as desired for rapidly cooling the molten aluminum alloy in the mold cavity 32. As a result, the casting cycle time is shortened for efficient casting operation. In the illustrated embodiment, one casting cycle in the actual casting process was 3 minutes which is about half the conventional casting cycle.

Figure 4:
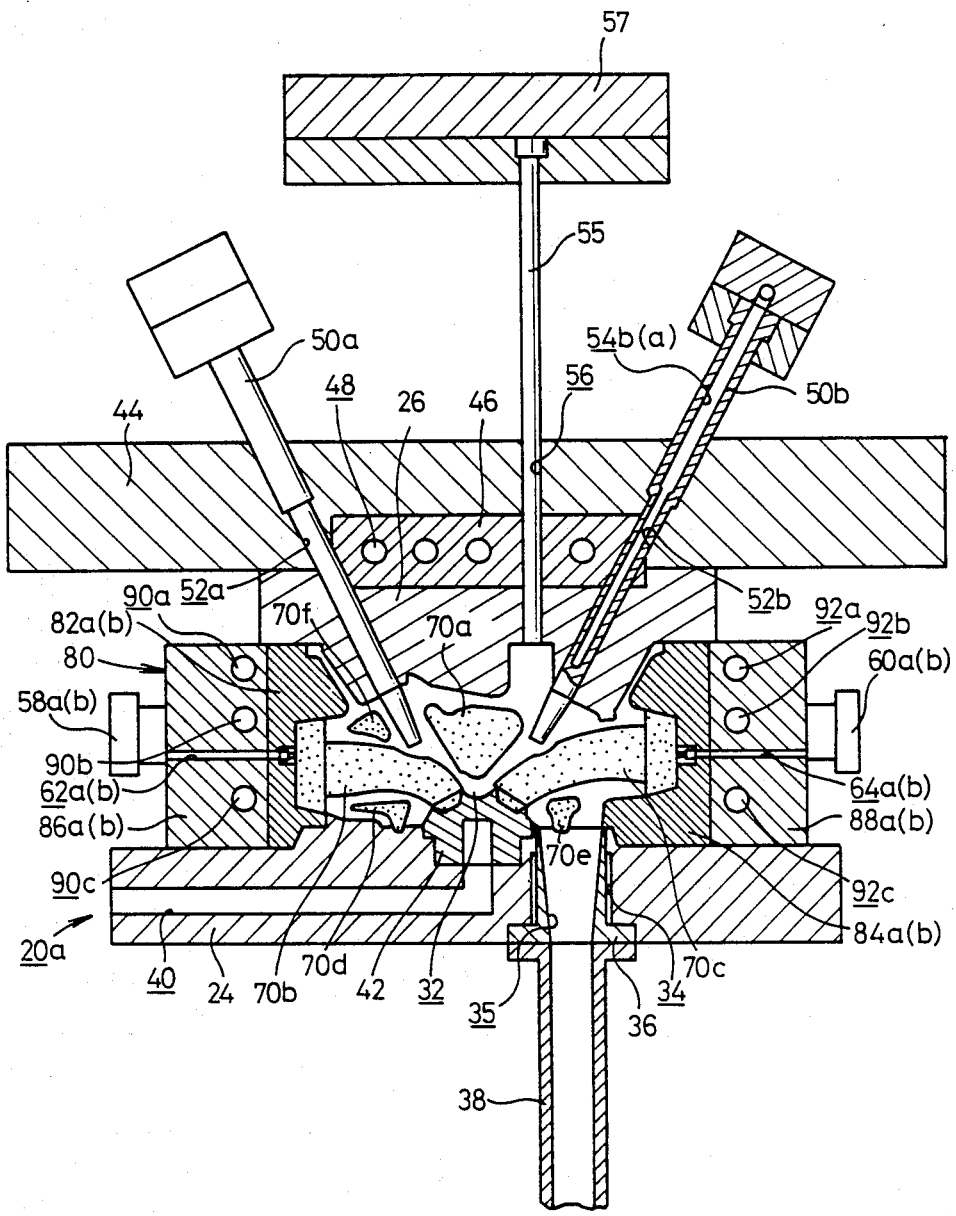
FIG. 4 is a vertical cross-sectional view of a low-pressure casting apparatus employed for carrying out a method of low pressure casting of a light metal alloy according to another embodiment of the present invention.

FIG. 4 shows a casting apparatus 20*a* for carrying out a low-pressure casting method according to another embodiment of the present invention. The casting apparatus 20*a* includes a mold assembly 80 which is substantially the same as the mold assembly 22 shown in FIG. 3 except for slidable molds thereof. More specifically, the mold assembly 80 includes slidable molds 82*a*, 82*b* and 84*a*, 84*b* with cooling blocks 86*a*, 86*b* and 88*a*, 88*b* held in intimate contact with their backs, respectively. The cooling blocks 86*a*, 86*b* and 88*a*, 88*b* have passages 90*a* through 90*c*, 92*a* through 92*c* defined therein for passage of a cooling fluid supplied and discharge by a cooling fluid supply/discharge system (not shown). The other components of the casting apparatus 20*a* are identical to those of the casting apparatus 20, and are denoted by identical reference characters and will not be described in detail.

The low-pressure casting method for casting a light metal alloy by employing the casting mold assembly 80 will be described below.

In this low-pressure casting method, the molds and cooling blocks of the mold assembly 80 are made of metallic materials indicated in the following table 2:

TABLE 2

| | Material | Thermal conductivity cal/cm · s · °C. |
|---|---|---|
| Lower mold 24 | JIS SKD 61 | 0.08 |
| Slidable molds 82a(b) | Be—Cu alloy | 0.45 |
| Cooling blocks | | |

TABLE 2-continued

| | Material | Thermal conductivity cal/cm · s · °C. |
|---|---|---|
| 86a(b) Slidable molds | Cu alloy | 0.90 |
| 84a(b) Cooling blocks | Be —Cu alloy | 0.45 |
| 88a(b) | Cu alloy | 0.90 |
| Upper mold 26 | Cr—Cu alloy | 0.77 |
| Cooling block 46 | Cu alloy | 0.90 |

The sand cores 70*a* through 70*f* are placed in position in the mold cavity 32 defined in the mold assembly 80. Thereafter, the cylinders (not shown) are actuated to move the upper mold 26, and the slidable molds 82*a*, 82*b* and 84*a*, 84*b* toward the lower mold 24 to complete the mold assembly 80.

A molten aluminum alloy of JIS AC 2B is introduced into the mold cavity 32 from the stalk 38 via the sprue 35 in the nozzle 36. At this time, the molten aluminum alloy is kept at a temperature of 680° C., held in the mold cavity 32 under a pressure of 0.28 kg/cm$^2$, and kept in the mold cavity 32 for a casting cycle of 140 seconds. More specifically, the molten aluminum alloy stored in the non-illustrated pot is maintained at 680° C., and compressed air is applied to the surface of the molten aluminum alloy in the pot to feed the molten aluminum alloy through the stalk 38 and the sprue 35 into the mold cavity 32 where the molten aluminum alloy is held under a pressure of 0.28 kg/cm$^2$.

In the second embodiment, after the molten aluminum alloy has started being pressurized, cooling mediums are supplied to the molds at different times indicated in the following table 3:

TABLE 3

| | Cooling conditions | |
|---|---|---|
| | Cooling started (after starting pressurization) | Cooling medium |
| Lower mold 24 | 40 seconds | Air |
| Slidable molds 82a(b) | 30 seconds | Water |
| Slidable molds 84a(b) | 30 seconds | Water |
| Upper mold 26 | 10 seconds | Water |

First, the cooling medium or water is supplied from a water supply source (not shown) into the holes 48 defined in the cooling block 46 between the upper mold 26 and the movable mold base 44, 10 seconds after the molten aluminum alloy filled in the mold cavity 32 has started being pressurized under 0.28 kg/cm$^2$. Therefore, the upper mold 26 is thereafter cooled through the cooling block 46.

Then, upon elapse of 30 seconds after the molten aluminum alloy has started to be pressurized, the cooling medium or water is supplied from the non-illustrated water supply source into the passages 90*a* through 90*c* and 92*a* through 92*c* defined in the cooling blocks 86*a*, 86*b* and 88*a*, 88*b* mounted on the slidable molds 82*a*, 82*b* and 84*a*, 84*b*. To prevent a misrun which would otherwise be developed by excessive cooling of thin portions of the mold cavity 32 which are defined by the upper mold 26 and the slidable molds 82*a*, 82*b* and 84*a*, 84*b*, it is preferable to supply the cooling water into the passages 90*a*, 92*a* at a slightly reduced rate. On the other hand, to prevent a delay in solidification of the molten aluminum alloy in thick portions of the mold cavity 32 which are defined by the slidable molds 82*a*, 82*b* and 84*a*, 84*b* and the sand cores 70*b*, 70*c*, the cooling water is supplied into the passages 90*b*, 90*c* and 92*b*, 92*c* at a rate higher than the rate of supply of the cooling water into the passages 90*a*, 92*a*. As a consequence, the slidable molds 82*a*, 82*b* and 84*a*, 84*b* are cooled by the cooling blocks 90*a*, 90*b* and 92*a*, 92*b*.

Upon 40 seconds after the starting of pressurization of the molten aluminum alloy, the cooling medium or air is supplied from an air supply source (not shown) into the hole 40 defined in the lower mold 24 to cool the lower mold 24.

As described above, the mold assembly 80 of the second embodiment is constructed of the molds of different thermal conductivities that are progressively smaller from the upper mold 26 toward the lower mold 24, and the molds are cooled under different cooling conditions for cooling and solidifying the molten aluminum alloy filled in the mold cavity 32. As shown in the table 2, the upper mold 26 is made of a chromium-copper alloy which is of the highest thermal conductivity among the mold materials, and the cooling block 46 is made of a copper alloy which is of a good thermal conductivity. Therefore, the cooling effect of water which is introduced into the holes 48 in the cooing block 46 is effectively transmitted to the upper mold 26 because of the high thermal conductivity of the cooling block 46. This, together with the fact that the upper mold 26 starts being cooled at the earliest time, is effective in solidifying the thick portion of the molten aluminum alloy facing the upper mold 26 and the sand core 70*a* at first, so that this portion of the molten aluminum alloy is prevented to have casting defects such as shrinkage cavities which would otherwise be developed by a solidification delay.

The slidable molds 82*a*, 82*b* and 84*a*, 84*b* are made of beryllium bronze, the thermal conductivity of which is the next highest among the mold materials, i.e., next lower than that of the material of the upper mold 26, and the cooling blocks 86*a*, 86*b* and 88*a*, 88*b* are made of a copper alloy of a good thermal conductivity. The slidable molds 82*a*, 82*b* and 84*a*, 84*b* start being cooled 20 seconds later than the upper mold 26 starts being cooled. The lower mold 24 is made of carbon tool steel having the lowest thermal conductivity, and starts being cooled at the latest time by air which is of a lower cooling ability than water, as indicated in the table 3. The thermal conductivities of the mold materials are combined to give rise to a progressive cooling gradient across the mold cavity 32, and the progressive cooling capability is increased by giving the molds different cooling conditions. As a result, the cooling effects which the molds have on the molten aluminum alloy filled in the mold cavity 32 are different from each other. The molten aluminum alloy is therefore progressively solidified in a direction from the upper mold 26 through the slidable molds 82*a*, 82*b* and 84*a*, 84*b* toward the lower mold 24, resulting in a casting of good structure.

Since the rate of supply of cooling water into the holes 90*a*, 92*a* is slightly lower than the rate of supply of cooling water into the holes 90*b*, 90*c* and 92*b*, 92*c* in the cooling blocks 86*a*, 86*b* and 88*a*, 88*b* mounted on the slidable molds 82*a*, 82*b* and 84*a*, 84*b*, the thin portion of the casting which is formed between the upper mold 26 and the slidable molds 82*a*, 82*b* and 84*a*, 84*b* does not suffer a misrun due to excessive cooling.

After the molten aluminum alloy has been cooled for a given period of time, the compressed air is removed from the pot, and the mold assembly 20a is opened to obtain a cast cylinder head. According to the embodiment shown in FIG. 4, because of the different mold materials and the forced cooling process, the actual casting cycle time is reduced to 140 seconds which is ½ or less with respect to the conventional casting cycle time.

The molds and cooling blocks of the mold assembly 80 used in carrying out the low-pressure casting method of the second embodiment may be made of metallic materials as shown in the following table 4:

TABLE 4

| | Material | Thermal conductivity cal/cm · s · °C. |
|---|---|---|
| Lower mold 24 | JIS SKD 61 | 0.08 |
| Slidable molds 82a(b), 84a(b) | JIS SKD 61 | 0.08 |
| Cooling blocks 86a(b), 88a(b) | Cr—Cu alloy | 0.77 |
| Upper mold 26 | JIS SKD 61 | 0.08 |
| Cooling block 46 | Cr—Cu alloy | 0.77 |

As indicated in the table 4, the molds and blocks of the casting mold assembly 80 are made of materials which are suited for their functions. More specifically, the lower mold 24, the slidable molds 82a, 82b and 84a, 84b, and the upper mold 26 which jointly define the mold cavity 32 are made of a material which is durable against heat and has a good affinity for the molten aluminum alloy. Therefore, these molds which are held in direct contact with the high-temperature molten aluminum alloy in the mold cavity 32 and exposed to continuous thermal shock have a sufficient level of durability.

The cooling block 46 for the upper mold 26 is made of a copper alloy having a high thermal conductivity, and the cooling blocks 86a, 86b and 88a, 88b for the slidable molds 82a, 82b and 84a, 84bg are also made of a copper alloy. With these materials employed of the molds and cooling blocks, the molten aluminum alloy in the mold cavity 32 can progressively be solidified from the upper mold 26 via the slidable molds 82a, 82b and 84a, 84b toward the sprue 35 in the same manner as with the materials selected as shown in the table 2 above.

The cooling blocks 46, 86a, 86b and 88a, 88b are held in intimate contact with the substantially entire backs or rear surfaces of the upper mold 26 and the slidable molds 82a, 82b and 84a, 84b. Therefore, the cooling effect of these cooling blocks is applied uniformly to these molds for uniformly solidifying the portions of the molten aluminum alloy which contact these molds. As a consequence, the overall casting cycle is shortened, and the structure of a casting is prevented from having casting defects such as shrinkage cavities or the like. The casting thus produced is of a good structure and high quality.

The low-pressure casting method which is substantially the same as that carried out by the casting apparatus 20 of the first embodiment can be effected by the casting apparatus 20a of the second embodiment.

More specifically, the casting apparatus 20a is operated under the same casting conditions as those of the first embodiment are employed: An aluminum alloy of JIS AC2B is melted at a temperature of 680° C., held in the mold cavity 32 under a pressure of 0.28 kg/cm$^2$, and cast in a casting cycle of 3 minutes. After the molten aluminum alloy is kept in the mold cavity 32 under the above conditions for a given period of time, the compressed air is removed from the pot to allow the molten aluminum alloy in the mold cavity 32 to be solidified. At this time, a cooling medium such as water is supplied from a non-illustrated supply/discharge system into the passages 48 in the cooling block 46 on the back of the upper mold 26. Similarly, cooling water is passed through the passages 90a through 90c and 92a through 92c in the cooling blocks 86a, 86b and 88a, 88b on the slidable blocks 82a, 82b and 84a, 84b, and cooling water is passed through the passage 40 in the lower mold 24 dependent on the casting conditions. As a result, a good casting is produced in the same manner as with the first embodiment.

With the present invention, as described above, the molds of the mold assembly are made of materials of different thermal conductivities which are selected to be progressively lower in a certain direction toward the sprue. A molten metal alloy in the mold cavity in the mold assembly is thus progressively solidified in that direction for directional solidification due to the different and progressively varying thermal conductivities of the mold materials. Since the molten metal alloy in the mold cavity is progressively solidified toward the sprue, a resultant casting is prevented from suffering casting defects such as shrinkage cavities and is of a good structure and high quality. The thermal conductivities of the materials are relatively high to permit the solidification to progress rapidly, so that the casting cycle is shortened and the casting process is made efficient. Consequently, with the method and apparatus of the present invention, the percentage of defective castings produced is very low, but high-quality castings can be manufactured with resulting increased productivity.

Moreover, the mold assembly is constructed such that the different thermal conductivities of the mold materials are progressively lower in a certain direction toward the sprue, and the cooling conditions such as cooling starting times and cooling mediums are different for the respective molds, for thereby promoting directional solidification of the molten metal alloy in the mold cavity to cause the molten metal alloy to be progressively solidified from an end of the mold cavity toward the sprue. Accordingly, a produced casting does not have casting defects such as shrinkage cavities or the like, and is of a good structure and high quality. The aforesaid cooling conditions may be precisely selected dependent on the shape of a casting to be produced with a view to preventing a misrun in a thinner portion of the casting and a solidification delay in a thicker portion of the casting. Thus, castings of complex shapes can be produced without inducing casting defects therein. Since the solidification of the molten metal alloy is promoted by forced cooling of the mold assembly, the casting cycle is shortened, and the efficiency of the casting process is increased.

In addition, the cooling blocks are disposed in intimate contact with the substantially entire backs of the molds defining the mold cavity. The cooling blocks are made of a copper alloy for higher cooling efficiency with respect to the molten metal alloy in the mold cavity. Inasmuch as the solidification of the molten metal alloy progresses quickly, the casting cycle is shortened. Because the cooling effect is applied entirely, but not locally, to the molten metal alloy in the mold cavity, the quality of a produced casting is stabilized.

Although certain preferred embodiments have been shown and described, it should be understood that many changes and modifications may be made therein without departing from the scope of the appended claims.

What is claimed is:

1. A method of low-pressure casting of a light metal alloy, comprising the steps of:

applying a fluid pressure on the surface of a light metal alloy stored in a closed container to introduce the light metal alloy from the closed container through a transfer tube and a sprue into a mold cavity defined in a mold assembly;

bringing the introduced molten metal alloy into contact with molds of said mold assembly which comprise metallic material having different thermal conductivities, respectively; and controlling a time in which the molten metal alloy is solidified with said molds to produce a casting.

2. A method according to claim 1, wherein the molten metal alloy is brought into contact with at least two molds of said mold assembly which have respective different thermal conductivities, the mold of a higher thermal conductivity being disposed in a region where the molten metal alloy is to be solidified earlier and the mold of a lower thermal conductivity being disposed in a region where the molten metal alloy is to be solidified later, for thereby controlling the time in which the molten metal alloy is solidified.

3. A method according to claim 1 or 2, wherein the molten metal alloy is progressively solidified downwardly toward the mold which has said sprue.

4. A method according to claim 3, wherein the mold of a higher thermal conductivity is made of a copper alloy and the mold of a lower thermal conductivity is made of carbon tool steel.

5. A method according to claim 3, wherein said molds are supplied with a cooling medium under cooling conditions including the type of the cooling medium, a cooling starting time, and a flow rate, for forcibly cooling the molten metal alloy.

6. A method according to claim 5, wherein said cooling medium is air and/or water.

7. A method according to claim 1 or 2, wherein the mold of a higher thermal conductivity is made of a copper alloy and the mold of a lower thermal conductivity is made of carbon tool steel.

8. A method according to claim 7, wherein said molds are supplied with a cooling medium under cooling conditions including the type of the cooling medium, a cooling starting time, and a flow rate, for forcibly cooling the molten metal alloy.

9. A method according to claim 8, wherein said cooling medium is air and/or water.

10. A method according to claim 9, wherein said upper, lower, and slidable molds are supplied with a cooling medium.

11. A method according to claim 1 or 2, wherein said molds are supplied with a cooling medium under cooling conditions including the type of the cooling medium, a cooling starting time, and a flow rate, for forcibly cooling the molton metal alloy.

12. A method according to claim 11, wherein said cooling medium is air and/or water.

13. An apparatus for low-pressure casting of a light metal alloy, comprising:

a mold assembly defining a mold cavity for receiving a light metal alloy therein, said mold assembly being composed of an upper mold, a lower mold having a sprue, and slidable molds separably fitted in said upper and lower molds, said upper, lower, and slidable molds being made of metallic materials having different thermal conductivities which are progressively lower in a direction from said upper mold toward said lower mold.

14. An apparatus according to claim 13, wherein at least said upper and slidable molds are made of a copper alloy having a higher thermal conductivity, and said lower mold is made of carbon tool steel having a lower thermal conductivity.

15. An apparatus according to claim 13 or 14, further comprising cooling blocks disposed in intimate contact with substantially entire rear surfaces of at least said upper and slidable molds remote from said mold cavity, said cooling blocks being made of a copper alloy of a higher thermal conductivity and having passages defined therein for passage of a cooling medium supplied and discharged by a cooling medium supply/discharge system.

16. An apparatus according to claim 15, wherein said upper, slidable, and lower molds comprise carbon tool steel.

17. An apparatus according to claim 13 or 14, wherein said upper, lower, and slidable molds are supplied with a cooling medium.

18. An apparatus according to claim 17, wherein the cooling medium supplied to said upper and slidable molds is water, and the cooling medium supplied to said lower mold is air or water.

19. An apparatus according to claim 13 or 14, further comprising cooling blocks mounted on at least said upper and slidable molds and having holes defined therein for passage of a cooling medium which is controllably supplied.

20. An apparatus according to claim 15, wherein said upper, lower, and slidable molds are supplied with a cooling medium.

* * * * *